US005704490A

United States Patent [19]

Reynard

[11] Patent Number: 5,704,490

[45] Date of Patent: Jan. 6, 1998

[54] ELECTROSTATIC SEPARATION OF PARTICULATE MATERIAL

[75] Inventor: Joseph Robert Reynard, Southampton, United Kingdom

[73] Assignee: British-American Tobacco Company Limited, Middlesex, United Kingdom

[21] Appl. No.: 455,324

[22] Filed: May 31, 1995

[30] Foreign Application Priority Data

Jun. 17, 1994 [GB] United Kingdom ..... 9412130

[51] Int. Cl.[6] ..... B03C 7/02

[52] U.S. Cl. ..... 209/128; 209/127.1; 209/127.2; 131/290

[58] Field of Search ..... 209/12.2, 127.1, 209/127.2, 127.3, 127.4, 128, 129, 130, 631, 689, 690, 908, 920; 131/290

[56] References Cited

U.S. PATENT DOCUMENTS

| | | | |
|---|---|---|---|
| 1,153,182 | 9/1915 | Schniewind | 209/130 X |
| 2,187,637 | 1/1940 | Sutton et al. | 209/129 |
| 2,548,771 | 4/1951 | Carpenter | 209/127.1 |
| 3,031,079 | 4/1962 | Boss | 209/128 |
| 3,308,948 | 3/1967 | Barthelemy | 209/127.1 |
| 3,322,275 | 5/1967 | Breakiron et al. | 209/127.1 |
| 3,970,546 | 7/1976 | Webb et al. . | |
| 4,116,822 | 9/1978 | Webb | 209/127.1 X |
| 4,374,727 | 2/1983 | Takahashi et al. . | |

FOREIGN PATENT DOCUMENTS

| | | | |
|---|---|---|---|
| 543417 | 3/1977 | U.S.S.R. | 209/128 |
| 624651 | 9/1978 | U.S.S.R. | 209/128 |
| 1282903 | 1/1987 | U.S.S.R. | 209/128 |
| 1331567 | 8/1987 | U.S.S.R. | 209/128 |
| 1558485 | 4/1990 | U.S.S.R. | 209/128 |

*Primary Examiner*—Frank E. Werner
*Attorney, Agent, or Firm*—Kane, Dalsimer, Sullivan, Kurucz, Levy, Eisele and Richard

[57] ABSTRACT

Electrostatic separation is used to separate electrically conducting particles from electrical insulator particles by attracting the conducting particles to a separating electrode, whilst the insulator particles remain substantially attached to a carrier electrode. The electrical properties of the particles to be separated can be enhanced or even changed by controlling the moisture content of the particles to be separated.

16 Claims, 2 Drawing Sheets

ELECTROSTATIC SEPARATION OF PARTICULATE MATERIAL

BACKGROUND OF THE INVENTION

1. Field of the Invention

This invention relates to an electrostatic separation technique.

2. Brief Description of Related Art

In the production of smoking articles, such as cigarettes and cigars, there are often some articles which do not meet the quality standards of the manufacturer. These articles are rejected using various rejection techniques. The rejected articles are then subjected to tobacco recovery techniques, colloquially known, for example, as 'ripping'. In the ripping of rejected smoking articles tobacco often ends up mixed with other components of the articles. If the smoking article incorporated a filter element which also comprised carbon granules in, for example, Dalmatian, dual or triple carbon filter elements, loose carbon can also become mixed with the tobacco. Dalmatian filters have carbon granules interspersed throughout the filtration material. The presence of carbon granules in the tobacco utilised in a tobacco rod of a cigarette is undesirable because it detracts from the quality of the product and can lead to consumer complaints. It is, therefore, highly desirable to separate the tobacco particles and carbon granules from one another.

Various proposals have been made to use electrostatic separation as a technique to separate both sand and paper from tobacco, see, for example, U.S. Pat. No. 4,340,412, UK Patent Specification Nos. 2 029 731A and 1 374 308 and DE-OLS-23 07 075. These devices generally work by charging the particles of paper, sand and tobacco, the degree of charge being determined by the electrical conductivity of the particular particles, and attracting the particles away from the tobacco, which behaves as an electrical insulator at low moisture content. The removed particles of sand or paper are collected in a tray or other device.

It is an object of the present invention to provide a method of, and apparatus for, separating electrically conducting particles, such as carbon particles, from electrical insulator particles, such as tobacco particles or particles of filtration material.

It is a further object to attract the electrically conducted particles away from the electrical insulator particles.

SUMMARY OF THE INVENTION

The present invention provides a method of separating electrically conducting particles from electrical insulator particles, the method comprising the steps of passing a mixture of electrically conducting particles and electrical insulator particles onto a carrier electrode having an electrically conducting surface, a corona discharge device disposed above the carrier electrode providing an electrical charge to the particles, the charged electrically conducting particles discharging to the electrically conducting surface of the carrier electrode, which electrode is earthed, the discharged electrically conducting particles being attracted towards a charged separating electrode, the arrangement of the separating electrode being such as to laterally separate the electrically conducting particles from the electrical insulator particles.

The present invention further provides electrostatic separation apparatus for separating an electrically conducting particulate material from an electrical insulator particulate material, the apparatus comprising a carrier electrode having an electrically conducting surface, disposed above which electrode is supply means for the particles to be separated and a corona discharge device, the corona discharge device being connected to a high voltage electrical supply and being operable to provide an electrical charge to the particles to be separated, disposed in lateral relationship to the carrier electrode and the discharge device is a separating electrode positioned to attract discharged electrically conducting particulate material, and the voltage supplied to the corona discharge device being of the same potential as the voltage supplied to the separating electrode.

Preferably the electrical insulator particles are tobacco particles, which particles are preferably at a moisture content of less than 12%, more preferably at less than 10%, and even more preferably at less than 8%. The moisture content of the tobacco particles may advantageously be about 7%.

In the alternative, the electrical insulator particles may be cellulose acetate particles, which particles may be derived from the filtration material within carbon filter elements, for example. The filtration material may also be other insulator materials such as polypropylene or polyethylene.

Preferably the electrically conducting particles are carbon particles, which particles may be carbon, activated carbon or other carbonaceous material which conducts an electrical charge.

In a further alternative, when the electrical insulator particles are filtration material particles, the electrically conducting particles may be tobacco particles at a moisture content of greater than 10%, and preferably greater than 13% moisture.

Preferably filter elements or filter rods (pro-sizing to filter element length) containing particles to be separated are subjected to shredding and suitably also mechanical agitiation, and/or sieving, to produce particulate material before the electrostatic separation process.

Preferably the carrier electrode having an electrically conducting surface is a horizontally mounted rotating drum. Suitably the carrier electrode is of substantially the same width as the supply means. The supply means may suitably be a conveyor, preferably a vibrating conveyor. The supply means may also constitute a further conveyor.

Advantageously in adjacent relation to the carrier electrode is a scraper, such as a brush or scraper bar, for removing electrical insulator particles which have been charged from the carrier electrode. If the carrier electrode is a drum, the scraper is preferably located towards the underside of the drum.

Preferably the corona discharge device comprises a series of corona discharge devices. Advantageously, the discharge device comprises a support rod along which are spaced a series of corona discharge pins. Preferably each discharge pin and the support rod are provided with insulation means, such as a rubber insulating jacket. Advantageously the length and shape of the discharge pins is selected to give maximum performance. The preferred voltage range supplied to the corona discharge device is within 10–35 kV. When the discharge pins are arranged about 2 cm from the carrier electrode the voltage is advantageously within the range of 10–25 kV. When the discharge pins are arranged about 6 cm from the carrier electrode the voltage is advantageously within the range of 12–35 kV. The voltage selected will depend on the spacing from the carrier electrode and the degree of repulsion desired from the carbon particles.

The separating electrode is located downstream of the carrier electrode and is preferably a charged electrode plate. The plate is advantageously inclined at an acute angle to the underlying surface. Preferably the repulsed electrically conducting particles do not contact the charged electrode plate. The rotational speed of the drum is selected to give a trajectory to the electrically conducting particles. The rotational speed may be up to about 60 rpm, for a drum of 5 cm diameter, or less, for a larger drum. The inclination of the plate can be varied to increase the separation of the electrically conducting particles from the electrical insulator particles. The separating electrode is provided with a voltage also within the range of 10–35 kV. The separating electrode is of the same polarity as the corona discharge device.

The overall geometry of the separating electrode with respect to the carrier electrode, the length of the discharge pins and spacing thereof from the carrier electrode, and the voltage supplied to the discharge device all act together and can be varied to give the desired separation of the electrically conducting particles from the electrical insulator particles.

A receptacle for capturing the separated particles is provided and may be an elongate tray. Sections of the tray may be removable or otherwise connected to the same or further electrostatic separating apparatus for further passes of the particulate material through the separation apparatus.

Heating means may be provided to dry the supplied material, thus to control the electrical properties of one of the materials to be separated. The heating means is preferably located at the supply means. Moistening means may also be provided, located downstream of the separating process, to re-order the separated material, particularly tobacco if it has been dried to a moisture content of 10% or less.

BRIEF DESCRIPTION OF THE DRAWINGS

In order that the invention may be easily understood and readily carried into effect, reference will now be made, by way of example, to the accompanying diagrammatic drawings, in which.

DETAILED DESCRIPTION OF THE PREFERRED EMBODIMENTS OF THE INVENTION

Figure 1:
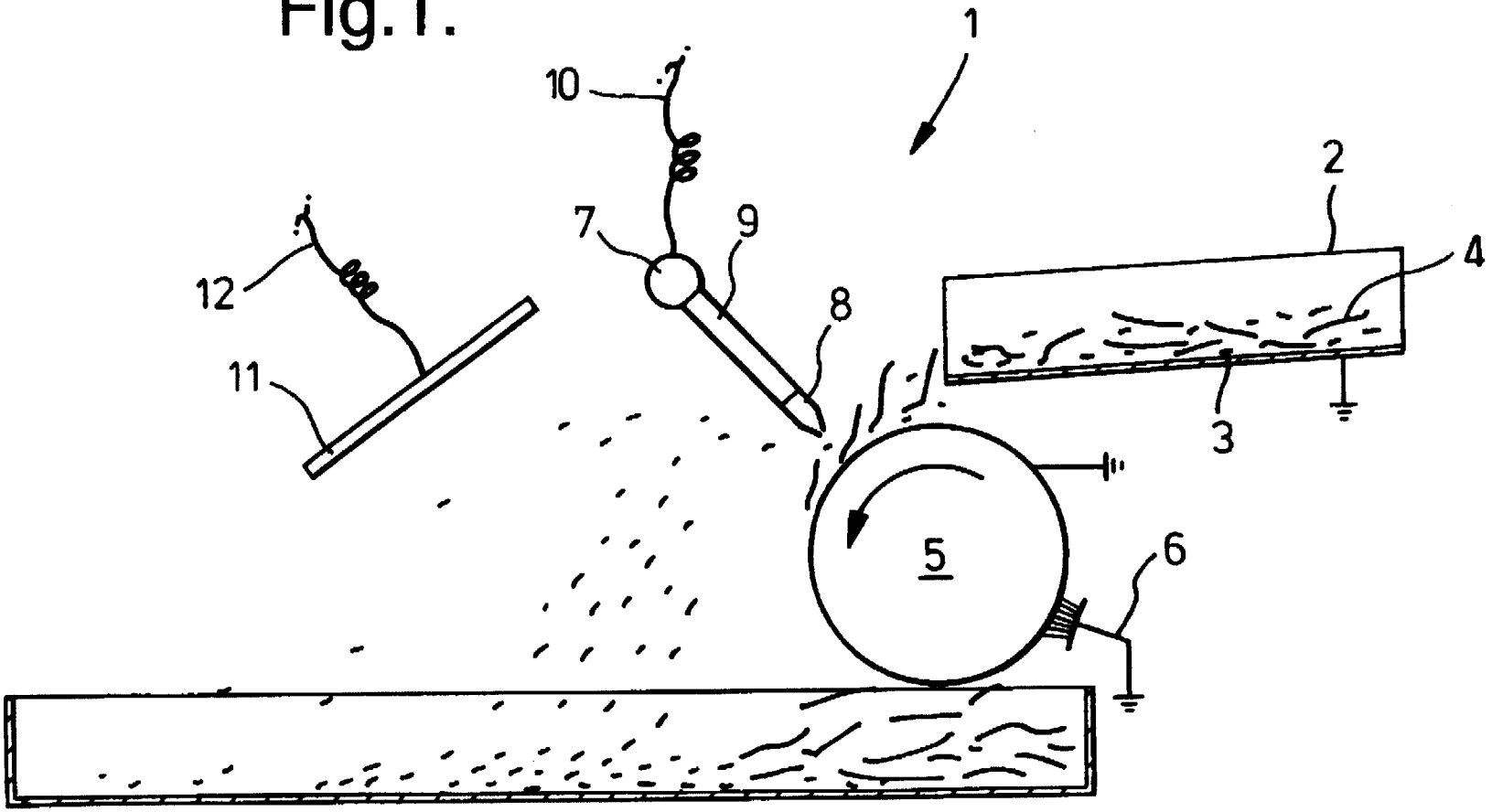
FIG. 1 shows in longitudinal cross-section electrostatic separation apparatus for separating carbon particles from tobacco particles.

FIG. 1 shows, in longitudinal cross-section, electrostatic separation apparatus 1 for separating carbon from material which acts substantially as an insulator. In this instance, carbon is separated from cut tobacco particles, but the apparatus may equally well be used to separate carbon found in carbon filter elements from cellulose acetate tow, for example.

The electrostatic separation apparatus 1 comprises supply means being a vibrating conveyor 2 which supplies a mixture of carbon particles 3, which in this instance are electrically conducting particles, and tobacco particles 4, which in this instance are electrical insulator particles, onto a carrier electrode in the form of a rotating drum 5 having a horizontal axis. Rotating drum 5 has a metallic surface. A brush 6 contacts the rotating drum 5 to remove any tobacco particles which remain on the drum. Above the drum but directed towards the drum and spaced along support rod 7 are a series of corona discharge pins, only one of which, discharge pin 8, is shown in the drawing. The support rod 7 and each of the discharge pins are insulated with a rubber insulating jacket 9. The corona discharge pins are connected to a high tension (high positive potential) source (not shown) through HT lead 10. The conveyor 2, drum 5 and brush 6 are all earthed. Inclined at an angle to the rotating drum 5 is an active separating electrode in the form of a charged plate 11 which charged plate 11 is connected to a HT source (not shown) via HT lead 12. Charged plate 11 and discharge pins 8 have the same charge polarity. Disposed below the drum 5 and extending below the charged plate 11 is a receptacle 13. Receptacle 13 may be divided into sections which feed back to more or the same electrostatic separation apparatus for further separation of the carbon and tobacco.

In operation, a mixture of electrically chargeable carbon particles 3 and cut tobacco particles 4 is fed onto rotating drum 5 from the vibrating conveyor 2. In order to ensure that the tobacco particles 4 do not lose their insulation characteristics the tobacco is dried to a moisture content of less than 12% moisture. In this instance, the tobacco moisture content was about 7% moisture. Discharge pins, such as discharge pin 8, spray a high voltage electric charge over the falling curtain of tobacco particles 4 and carbon particles 3. The carbon particles 3 become charged but discharge their charge to the metallic surface of the drum 5 as they fall against the drum 5. At the same time the carbon particles 3 become upwardly attracted towards positively charged plate 11. The combination of charge discharge, charge attraction and rotational trajectory from the drum speed can be adjusted to cause the carbon particles 3 to jump what may be a considerable distance away from rotating drum 5 without coming into contact with the electrodes; the discharge pins and charged plate 11.

The tobacco particles 4 being insulators substantially retain their positive charge and can remain pinned to the earthed rotating drum 5 due to the attractive Coulombic forces between unlike charges. The tobacco particles 4 either drop off the drum 5 or are removed by the action of the brush 6.

The efficiency of separation of carbon from tobacco by one pass through this apparatus is about 90%. Consecutive passes through the same or a cascade of similar apparatus can increase this efficiency at about 99%. Suitable apparatus is shown in FIG. 2.

Figure 2:
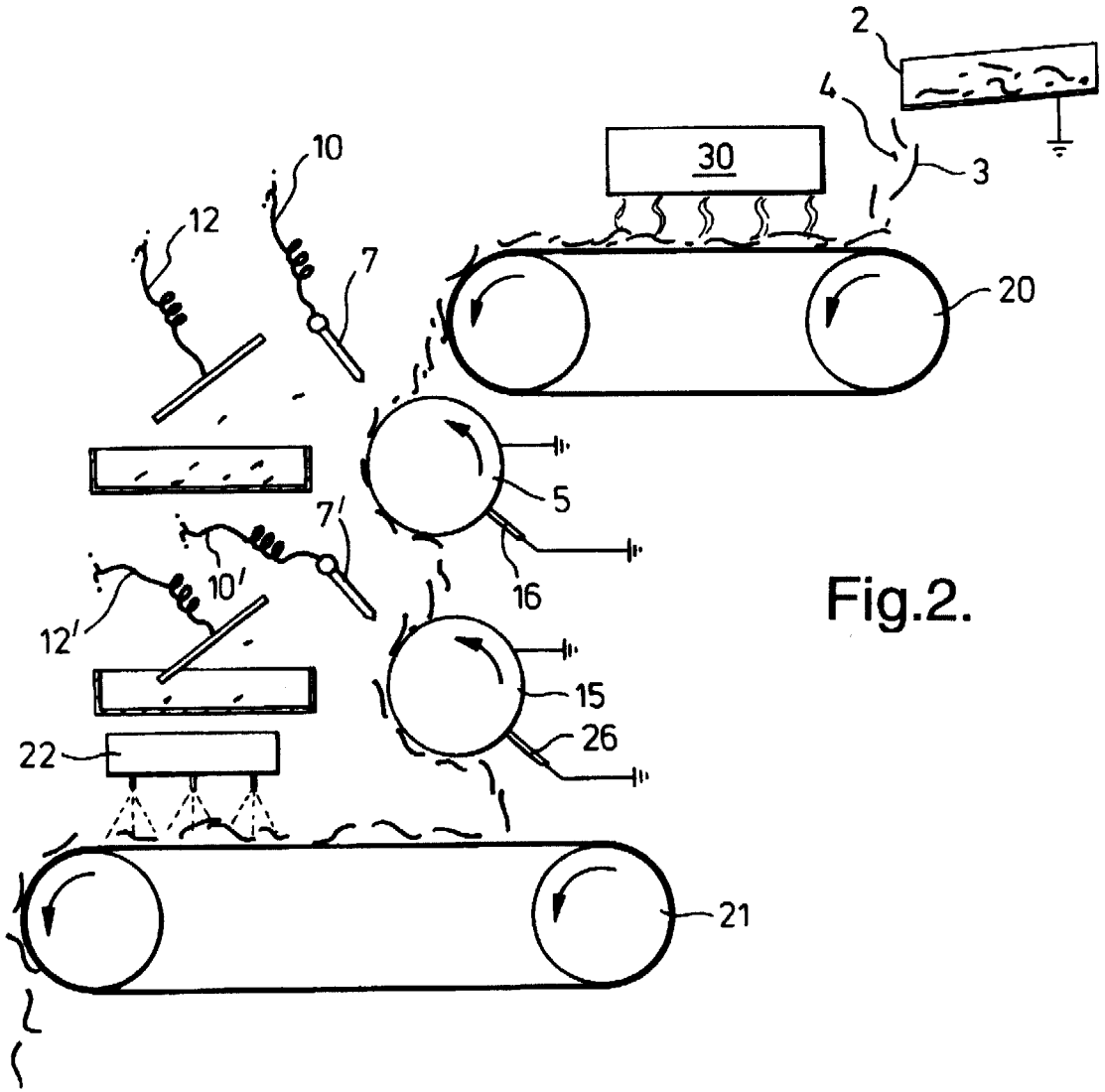
FIG. 2 shows in longitudinal cross-section a series of apparatus such as described in FIG. 1.

FIG. 2 shows, in longitudinal cross-section, a series of apparatus such as described in FIG. 1, with some modification or additions shown. Where the reference numerals denote identical or similar pieces of apparatus the same numerals are used as in FIG. 1. A vibrating conveyor 2 provides a mixture of carbon particles 3 and tobacco particles 4 onto a carrier electrode, in this instance also a rotating drum 5 having a horizontal axis. Rotating drum 5 has a metallic surface. A scraper 16 removes tobacco which remains on drum 5. Below drum 5 is located a second rotating drum 15, also with a scraper 26 for removing tobacco therefrom. Both scrapers 16 and 26 are earthed, as brush 6 in FIG. 1, as well as the conveyor 2 and drums 5 and 15. Located above both drums, one set over each, are insulated corona discharge pins 7 and 7', as in FIG. 1, connected to a high tension source through HT leads 10 and 10'. Inclined at an angle to each of the rotating drums 5 and 15 are each of an active separating electrode 11 and 11' connected to a HT source via HT leads 12 and 12'. The HT source may again be the same for the discharge devices 7 and 7' and the active separating electrodes 12 and 12'. Disposed below drum 26 is a further band conveyor 21 which receives the separated insulator particles, in this instance tobacco. Above the band conveyor 21 is moistening means in the form of a spray unit 22. The separated particles pass from band conveyor 21 to a receptacle (not shown).

The mixture of particles to be separated is supplied from the vibrating conveyor 2 to the first rotating drum via a band conveyor 20. Disposed above the band conveyor is heating means being, for example, a radiative heater 30. Other heaters may be used. In this embodiment vibrating conveyor 2 and band conveyor 20 constitute supply means.

In operation, the same process occurs as in FIG. 1 except that the process occurs twice in series to increase the efficiency of separation from 90% to 99%. As the tobacco is a better insulator at low moisture content it is dried before separation. However, in order to prevent undue degradation in this more brittle state, the tobacco is re-ordered/moistened to 13% moisture content after separation, preferably before passing to the storage receptacle.

Separation of carbon from filtration material, such as fibrous cellulose acetate, for example, is independent of relative humidity (moisture content) because of the inherent electrical conducting properties of the two materials.

By way of example of the efficiency of separation of carbon from filtration material the table below shows how the efficiency improves if the carbon filters are cut and sieved:

| | Method of Filter Shredding | | |
|---|---|---|---|
| | Comas 1 mm cut | Comas 2.5 mm cut, Electrostatic Separation | Comas 2.5 mm cut, Sieving, Electrostatic Separation |
| Weight of carbon recovered (g) | * | 4.12 | 4.98 |
| | * | 4.43 | 4.92 |
| | * | 3.97 | 5.31 |
| Average weight of carbon recovered (g) | * | 4.17<br>SD = 0.23 | 5.07<br>SD = 0.21 |
| Average % of carbon recovered | * | 59 | 72 |

The same principle and apparatus can also be used to separate filtration material, such as cellulose acetate, polyethylene or polypropylene, from tobacco. In this instance, in order to attract the tobacco, which usually acts as an insulator, to the separating electrode the tobacco is preferably at a moisture content of at least 10%, preferably at at least 13% moisture, and more preferably, at greater than 13% moisture. The tobacco in this moist state exhibits less insulating properties and more electrically conducting properties. In this instance, the water 30 and spray unit 22 can be reversed in order to increase the particle moisture content before separation and reduce it thereafter, if desired.

In the same way, the properties of other electrical insulator materials may be changed in order to make them more electrically conducting than other insulator materials.

I claim:

1. A method of separating electrically conducting carbon particles from electrical insulating tobacco particles, the moisture content of the tobacco supplied to the carrier electrode being less than 12%, the method comprising the steps of passing a mixture of carbon particles and tobacco particles onto a rotating carrier electrode having an electrically conducting surface, a corona discharge device disposed above the carrier electrode providing an electrical charge to the particles, the charged electrically conducting particles discharging to the electrically conducting surface of the carrier electrode, which electrode is earthed, the discharged carbon particles being attracted towards a separating electrode the arrangement of the separating electrode being such as to laterally separate the carbon particles from the tobacco particles.

2. A method according to claim 1, wherein the electrical insulator particles are at a moisture content of less than 10%.

3. A method according to claim 1 wherein the electrical insulator particles are at a moisture content of less than 8%.

4. A method according to claim 1, wherein the electrically conducting particles are at a moisture content of greater than 10%.

5. A method according to claim 1, wherein the moisture content of the tobacco particles supplied to the carrier electrode is less than 8%.

6. An electrostatic separation apparatus for separating an electrically conducting particulate material from an electrical insulator particulate material, the apparatus comprising a rotating carrier electrode having an electrically conducting surface, disposed above which electrode is supply means for the particles to be separated and a corona discharge device, the corona discharge device comprising a series of corona discharge pins, the corona discharge device being connected to a high voltage electrical supply and being operable to provide an electrical charge to the particles to be separated, disposed in lateral relationship to the carrier electrode and the discharge device is a separating electrode positioned to attract discharged electrically conducting particulate material, the separating electrode being a charged electrode plate, and the voltage supplied to the corona discharge device being of the same potential as the voltage supplied to the carrier electrode.

7. Apparatus according to claim 6, wherein the rotating carrier electrode is a rotating drum.

8. Apparatus according to claim 6, wherein the carrier electrode is of the same width as the supply means.

9. Apparatus according to claim 6, wherein a scraper is provided to remove electrical insulator particles from the carrier electrode.

10. Apparatus according to claim 6, wherein heating means is disposed at said supply means to heat the particles to be separated.

11. Apparatus according to claim 6, wherein moistening means is disposed either above a conveyor disposed at a downstream end of the separation apparatus to moisten dried separated particles or above a conveyor at an upstream end of the apparatus to moisten particles before separation.

12. A method of separating electrically conducting tobacco particles from electrically insulating filtration material particles, the moisture content of the tobacco particles supplied to a carrier electrode being greater than 10%, the method comprising the steps of passing a mixture of carbon particles and tobacco particles onto a rotating carrier electrode having an electrically conducting surface, a corona discharge device disposed above the carrier electrode providing an electrical charge to the particles, the charged electrically conducting particles discharging to the electrically conducting surface of the carrier electrode, which electrode is earthed, the discharged carbon particles being attracted towards a separating electrode, the arrangement of the separating electrode being such as to laterally separate the carbon particles from the tobacco particles.

13. A method according to claim 12, wherein the electrically conducting particles are at a moisture content of greater than 13%.

14. A method according to claim 12, wherein the moisture content of the tobacco particles supplied to the carrier electrode being greater than 13%.

15. A method of separating electrically conducting carbon particles from electrically insulating filtration material particles, the method comprising the steps of passing a mixture of carbon particles and tobacco particles onto a rotating carrier electrode having an electrically conducting surface, a corona discharge device disposed above the carrier electrode providing an electrical charge to the particles, the charged electrically conducting particles discharging to the electrically conducting surface of the carrier electrode which electrode is earthed, the discharged carbon particles being attracted towards a separating electrode, the arrangement of the separating electrode being such as to laterally separate the carbon particles from tobacco particles.

16. A method of separating electrically conducting tobacco particles from electrically insulating material particles, the moisture content of the tobacco particles supplied to the carrier electrode being greater than 10%, the method comprising the steps of passing a mixture of carbon particles and tobacco particles onto a rotating carrier electrode having an electrically conducting surface, a corona discharge device disposed above the carrier electrode providing an electrical charge to the particles, the charged electrically conducting particles discharging to the electrically conducting surface of the carrier electrode, which electrode is earthed, the discharged carbon particles being attracted towards a separating electrode, the arrangement of the separating electrode being such as to laterally separate the carbon particles from the tobacco particles.

* * * * *